US007735342B1

(12) United States Patent
Bailey

(10) Patent No.: US 7,735,342 B1
(45) Date of Patent: Jun. 15, 2010

(54) APPARATUS FOR FORMING AN UNBALANCED, CIRCULAR KNIT FABRIC AND A COATED FABRIC PRODUCED THEREFROM

(75) Inventor: Roger A. Bailey, Jefferson, SC (US)

(73) Assignee: Highland Industries, Inc., Greensboro, NC (US)

( * ) Notice: Subject to any disclaimer, the term of this patent is extended or adjusted under 35 U.S.C. 154(b) by 1504 days.

(21) Appl. No.: 10/874,148

(22) Filed: Jun. 22, 2004

(51) Int. Cl.
*D04B 15/88* (2006.01)

(52) U.S. Cl. ..... 66/8; 66/153

(58) Field of Classification Search ..... 66/8, 66/148, 149 R, 151, 153, 152; 26/71, 74, 26/75, 82, 86
See application file for complete search history.

(56) References Cited

U.S. PATENT DOCUMENTS 3,551,969 A * 1/1971 Cohn et al. ..... 26/96
3,619,831 A * 11/1971 Oberholtzer et al. ..... 81/149.1
3,670,375 A * 6/1972 Cohn et al. ..... 26/51.3
3,688,354 A * 9/1972 Cohn et. al. ..... 3/52
3,768,279 A * 10/1973 Butler ..... 66/147
3,864,794 A * 2/1975 Baumann ..... 26/82
3,892,342 A * 7/1975 Ogawa et al. ..... 223/57
3,934,766 A * 1/1976 Bailey ..... 223/73
3,943,613 A * 3/1976 Schraud et al. ..... 28/122
3,973,306 A * 8/1976 Catallo ..... 26/81
3,983,720 A * 10/1976 Eschenbach et al. ..... 66/147
4,058,874 A * 11/1977 Hausner ..... 28/153
4,134,188 A * 1/1979 Bryan ..... 26/18.5
4,183,318 A * 1/1980 Reynolds ..... 118/34
4,269,046 A * 5/1981 Strahm et al. ..... 68/13 R
4,365,373 A * 12/1982 Witte et al. ..... 8/150
4,484,369 A * 11/1984 Diggle et al. ..... 8/151
4,586,222 A * 5/1986 Catallo et al. ..... 26/51.3
4,608,767 A * 9/1986 Dornier ..... 34/103
4,773,133 A * 9/1988 Voisin et al. ..... 26/18.5
5,625,932 A * 5/1997 Catallo ..... 26/82
6,016,591 A * 1/2000 Strudel et al. ..... 26/81
6,174,486 B1 * 1/2001 Jin-Ya et al. ..... 264/327
6,354,017 B1 * 3/2002 Bertoldo ..... 34/115
6,663,678 B2 * 12/2003 Strudel et al. ..... 8/149.3

* cited by examiner

*Primary Examiner*—Danny Worrell
(74) *Attorney, Agent, or Firm*—MacCord Mason PLLC

(57) ABSTRACT

An apparatus for forming an unbalanced, circular knit fabric for coating in a subsequent operation, the apparatus comprising: a circular knitting station; and a thermal relaxation station downstream from the circular knitting station for relaxing the fabric in all directions. In the preferred embodiment of the invention, the apparatus includes a slitting station downstream from the circular knitting station. Also in the preferred embodiment, the apparatus includes a thermal finishing station downstream from the thermal relaxation station for setting the desired width of the fabric thereby also setting the desired stretch of the fabric in its length direction. A coated fabric, the coated fabric comprising a circular knitted, single knit fabric substrate, wherein the stretch of the fabric in the wale direction is greater than the stretch of the fabric in the course direction. In the preferred embodiment of the invention, the coated fabric further includes an outer coating. Also in the preferred embodiment, the fabric is formed by a four feed repeat.

62 Claims, 12 Drawing Sheets

APPARATUS FOR FORMING AN UNBALANCED, CIRCULAR KNIT FABRIC AND A COATED FABRIC PRODUCED THEREFROM

BACKGROUND OF THE INVENTION (1) Field of the Invention

The present invention relates generally to fabric knitting operations and, more particularly, to an apparatus for forming an unbalanced, circular knit fabric for coating in a subsequent operation and a coated fabric including a circular knitted, single knit fabric substrate, wherein the stretch of the fabric in the wale (length) direction is greater than the stretch of the fabric in the course (width) direction.

(2) Description of the Prior Art

It is often desirable to coat circular knit fabrics with vinyl to produce a durable material that is appealing to consumers for use in various seating and other applications. Conventional circular knit fabrics, however, normally have a much higher stretch in the width or "course" direction than in the length or "wale" direction. When a vinyl coating is applied to a conventional circular knit fabric substrate, the material has reduced stretch in both directions, including a much lower stretch in the in the wale direction than in the course direction. When the vinyl coated material is cut into parts and sewn into seating, or other products, a reduced "tailorability" results. Thus, the material may "pucker" or "bunch up" when sewing around curves and corners. The resulting material has a reduced "tailorability." The stretches are further degraded in both directions after vinyl coating. The vinyl material ends up with lower stretches, the length much lower than the width. When this material is cut into parts and sewn into seating or other products, the "tailorability" is not good. When sewing around curves or corners, the material "puckers" or bunches up. These problems result from the unbalanced nature of the circular knit substrate.

One way to resolve this low "tailorability" problem is to produce a circular knit fabric with higher stretch in the length than the width direction such that after a vinyl coating is applied, the resulting material has "balanced stretches". A vinyl fabric having balanced stretches would be expected to have improved "tailorability" versus conventional vinyl fabrics. The fabric would also enable an improved material utilization because patterns could be drawn in any direction, since the material would react similarly from various angles during subsequent processing.

Thus, there remains a need for an apparatus for forming an unbalanced, circular knit fabric for coating in a subsequent operation, the apparatus including: a circular knitting station; and a thermal relaxation station downstream from said circular knitting station for relaxing said fabric in all directions. There is also a need for a coated fabric including a circular knitted, single knit fabric substrate, wherein the stretch of the fabric in the wale direction is greater than the stretch of said fabric in the course direction.

SUMMARY OF THE INVENTION

The present invention is directed to an apparatus for forming an unbalanced, circular knit fabric for coating in a subsequent operation, the apparatus comprising: a circular knitting station; and a thermal relaxation station downstream from the circular knitting station for relaxing the fabric in all directions. In the preferred embodiment of the invention, the apparatus includes a slitting station downstream from the circular knitting station. Also in the preferred embodiment, the apparatus includes a thermal finishing station downstream from the thermal relaxation station for setting the desired width of the fabric thereby also setting the desired stretch of the fabric in its length direction.

The thermal relaxation station may include an overfeed device for overfeeding the fabric in the wale direction. The overfeed of the overfeed device may be greater than the fabric length shrinkage. The ratio of the overfeed to the fabric length shrinkage may be about 1.4. The overfeed device may include a three zone, tensionless dryer. The first zone may be about 150° F. air temperature, the second zone may be about 200° F. air temperature and the third zone may be about 230° F. air temperature. The thermal relaxation station may be between about 100° F. and 400° F. average air temperature. The thermal relaxation station may be about 225° F. average air temperature. The slitting station may be a side slitter and may further include a spreader and/or an accumulator downstream from the spreader. The apparatus may further include a substantially tension free transfer station downstream from the thermal relaxation station. The substantially tension free transfer station may include an accumulator and/or a buggy and/or a belt conveyor.

In the preferred embodiment of the invention, the thermal finishing station may be an overfeed tenter frame. The overfeed tenter frame may be a pin-type tenter frame. The application temperature of the thermal finishing station may be between about 100° F. and 300° F. fabric temperature. The application temperature may be about 200° F. fabric temperature. The thermal finishing station may further include a fabric width trimmer. The thermal finishing station may further include a take-up roll. The circular knitting station may form a single knit fabric. The single knit fabric may be a modified LaCoste construction. The modified LaCoste construction may be a four feed repeat. The four feed repeat may have a cam set up according to the following table:

| | F1 | F2 | F3 | F4 |
|---|---|---|---|---|
| T1 | K | K | W | T |
| T2 | W | T | K | K |

where K=Knit, W=Welt, and T=Tuck. The four feed repeat may have a needle set up according to the following table:

| | F1 | F2 | F3 | F4 |
|---|---|---|---|---|
| T1 | X | | X | |
| T2 | | X | | X |

where X=Needle In. The circular knitting machine may be between about an 18 inch and 60 inch diameter cylinder. The circular knitting machine may be a 30 inch diameter cylinder. The circular knitting machine may be between about a 12 and 28 cut. The circular knitting machine may be an 18 cut.

Accordingly, one aspect of the present invention is to provide an apparatus for forming a unbalanced circular knit fabric for coating in a subsequent operation, the apparatus including: a circular knitting station; and a thermal relaxation station downstream from the circular knitting station for relaxing the fabric in all directions.

Another aspect of the present invention is to provide an apparatus for forming an unbalanced circular knit fabric for coating in a subsequent operation, the apparatus including: a circular knitting station; a slitting station downstream from the circular knitting station; and a thermal relaxation station downstream from the circular knitting station for relaxing the fabric in all directions.

Still another aspect of the present invention is to provide an apparatus for forming an unbalanced, circular knit fabric for coating in a subsequent operation, the apparatus including: a circular knitting station; a slitting station downstream from the circular knitting station; a thermal relaxation station downstream from the circular knitting station for relaxing the fabric in all directions; and a thermal finishing station downstream from the thermal relaxation station for setting the desired width of the fabric thereby also setting the desired stretch of the fabric in its length direction.

The present invention is further directed to a coated fabric, the coated fabric comprising a circular knitted, single knit fabric substrate, wherein the stretch of the fabric in the wale direction is greater than the stretch of the fabric in the course direction. In the preferred embodiment of the invention, the coated fabric further includes an outer coating. Also in the preferred embodiment, the fabric is formed by a four feed repeat.

In the preferred embodiment of the invention, the outer coating may be a synthetic coating, such as a vinyl coating. The coated fabric may further including an intermediate coating between the fabric substrate and the outer coating. The intermediate coating may further include an adhesive. The intermediate coating may further include an expander.

In the preferred embodiment of the invention, the width direction stretch of the circular knitted fabric substrate may be between about 130% and 180%, preferably about 150%. The course direction stretch of the circular knitted fabric substrate may be between about 90% and 120%, preferably about 105%. The ratio of the wale direction shrinkage of the circular knitted fabric substrate to the course direction shrinkage of the circular knitted fabric substrate may be between about 1.05 and 2, preferably about 1.5.

In the preferred embodiment of the invention, the circular knitted fabric substrate is formed from continuous multi filament yarn. The continuous multi filament yarn may be 1/150/36. The continuous multi filament yarn may be a "high shrink". The Leesona shrinkage of the "high shrink" yarn may be between about 20-60%, preferably about 44%.

In the preferred embodiment of the invention, the outer coating is a synthetic coating, such as a vinyl coating. The coated fabric may include an intermediate coating between the fabric substrate and the outer coating. The intermediate coating includes an adhesive. The intermediate coating further includes an expander.

Another aspect of the present invention is to provide a coated fabric including: a circular knitted, single knit fabric substrate, wherein the stretch of the fabric in the wale direction is greater than the stretch of the fabric in the course direction.

Yet another aspect of the present invention is to provide a coated fabric including: a circular knitted, single knit fabric substrate, wherein the stretch of the fabric in the wale direction is greater than the stretch of the fabric in the course direction, the fabric being formed by a four feed repeat.

Still another aspect of the present invention is to provide a coated fabric including: a circular knitted, single knit fabric substrate, wherein the stretch of the fabric in the wale direction is greater than the stretch of the fabric in the course direction, the fabric being formed by a four feed repeat; and an outer coating.

These and other aspects of the present invention will become apparent to those skilled in the art after a reading of the following description of the preferred embodiment when considered with the drawings.

DESCRIPTION OF THE PREFERRED EMBODIMENTS

Figure 1:
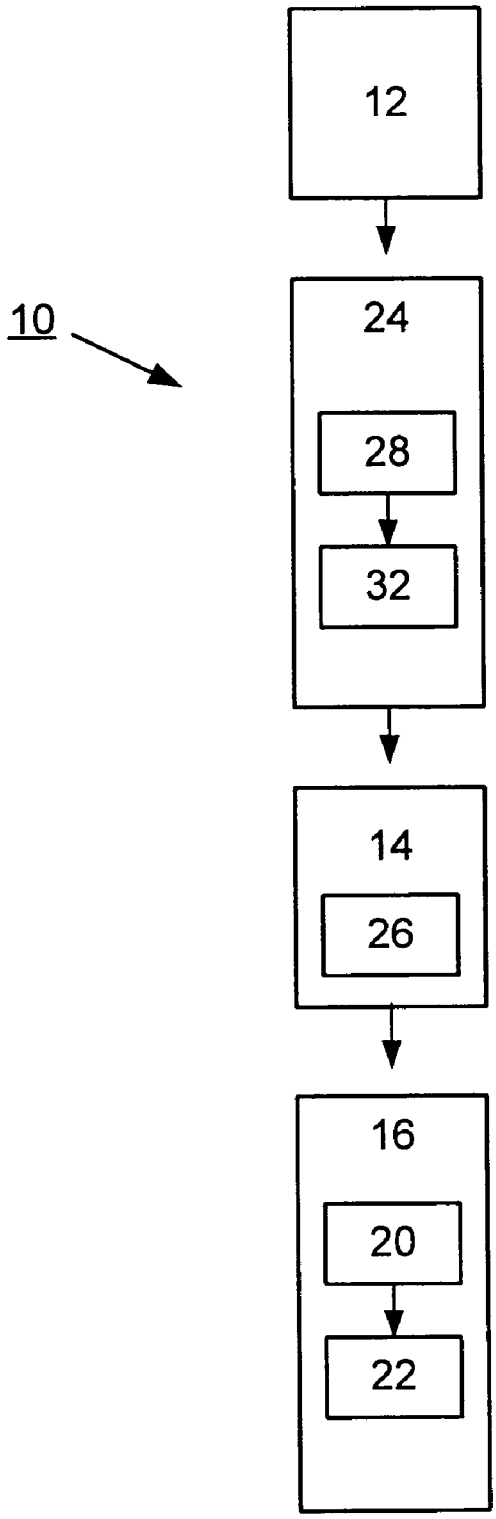
FIG. 1 is a block diagram depicting an apparatus for forming an unbalanced, circular knit fabric for coating in a subsequent operation constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. FIG. 1 is a highly schematic block diagram depicting an apparatus for forming an unbalanced, circular knit fabric for coating in a subsequent operation, generally designated 10, constructed according to the present invention. The apparatus for forming an unbalanced, circular knit fabric 10 includes a circular knitting station 12, and, in the preferred embodiment, the apparatus for forming an unbalanced, circular knit fabric 10 also includes a slitting station 24 downstream from said circular knitting station 12. The slitting station 24 is a side slitter. The slitting station may further include a spreader 28 and an accumulator 32. The apparatus for forming an unbalanced, circular knit fabric 10 includes a thermal relaxation station 14 downstream from the circular knitting station 12 for relaxing fabric in all directions. The relaxation station 14 includes an overfeed roll 26. The apparatus for forming an unbalanced, circular knit fabric 10 includes a thermal finishing station 16 downstream from the thermal relaxation station 14 for setting the desired width of the fabric thereby also setting the desired stretch of the fabric in its length direction. The thermal finishing station 16 may include a fabric width trimmer 20 and may further include a fabric take-up roll 22.

Figure 2:
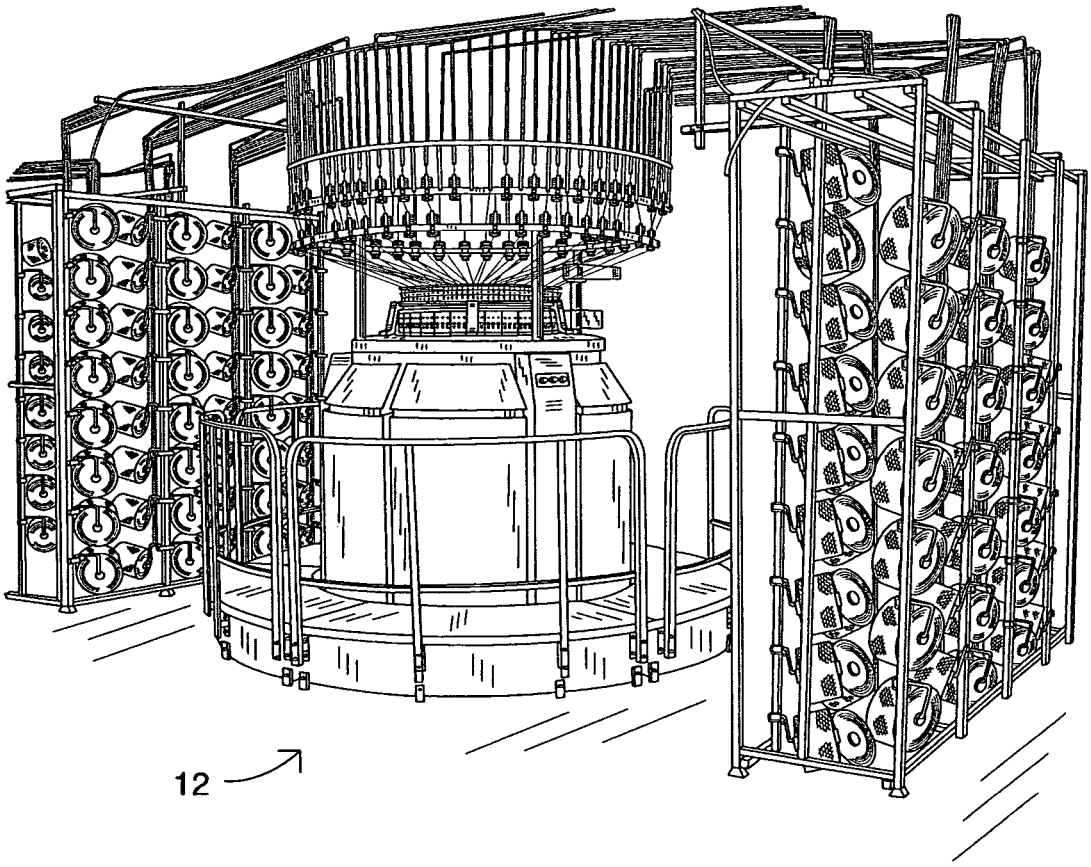
FIG. 2 is a perspective view of a circular knitting machine.
Figure 3:
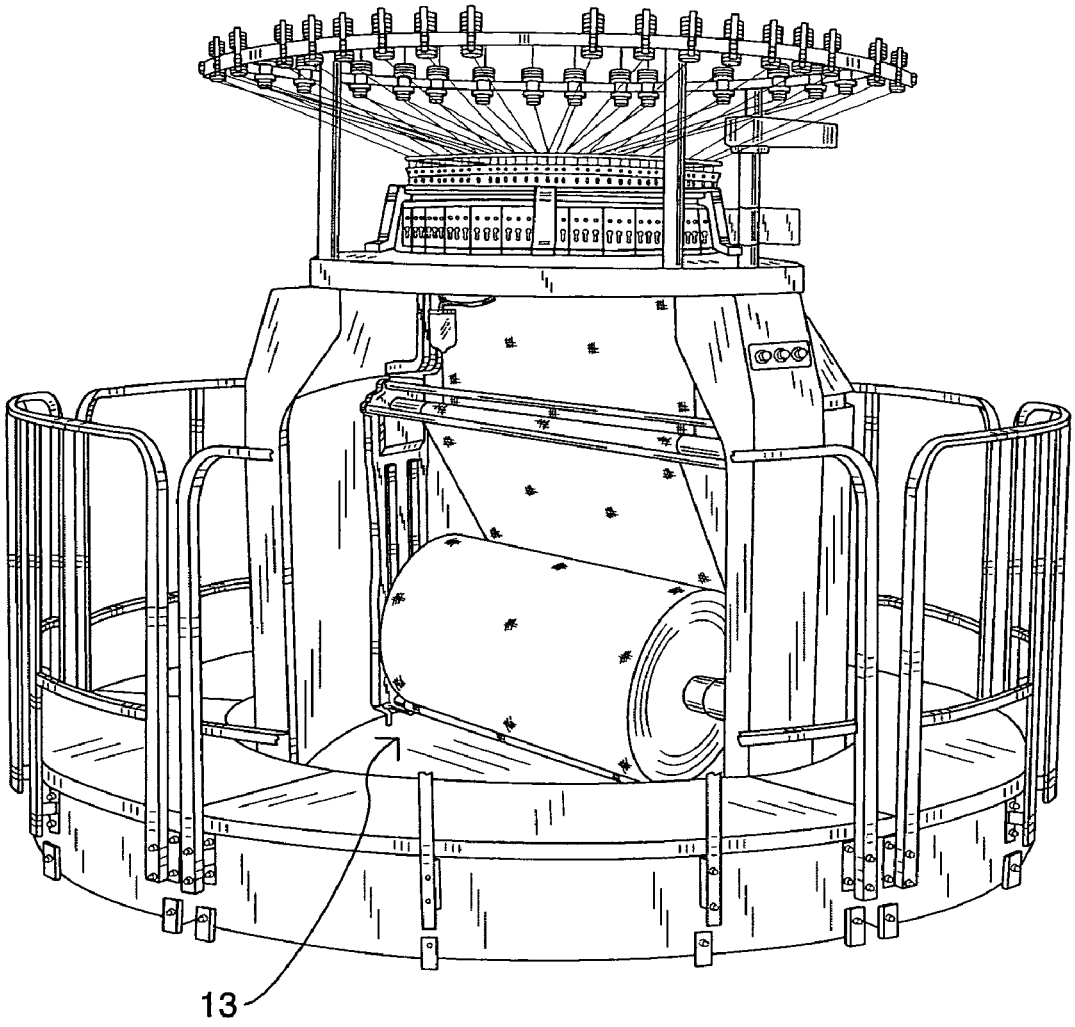
FIG. 3 is an additional perspective view of the circular knitting station of FIG. 2.

FIG. 2 is a perspective view of a circular knitting station 12 and FIG. 3 is a perspective view of the circular knitting machine 13. The circular knitting station 12 includes a circular knitting machine 13. The circular knitting station 12 forms a single knit fabric. The single knit fabric is a modified LaCoste construction. The modified LaCoste construction is a four feed repeat. The four feed repeat has a cam set up according to the following table:

| | F1 | F2 | F3 | F4 |
|---|---|---|---|---|
| T1 | K | K | W | T |
| T2 | W | T | K | K |

where K=Knit, W=Welt, and T=Tuck. The four feed repeat has a needle set up according to the following table:

| | F1 | F2 | F3 | F4 |
|---|---|---|---|---|
| T1 | X | | X | |
| T2 | | X | | X |

where X=Needle In. The circular knitting machine 13 is between about an 18 inch and 60 inch diameter cylinder. Preferably, the circular knitting machine 13 is a 30 inch diameter cylinder. The circular knitting machine is between about a 12 and 28 cut. Preferably, the circular knitting machine is an 18 cut (about 1740 needles).

Figure 4:
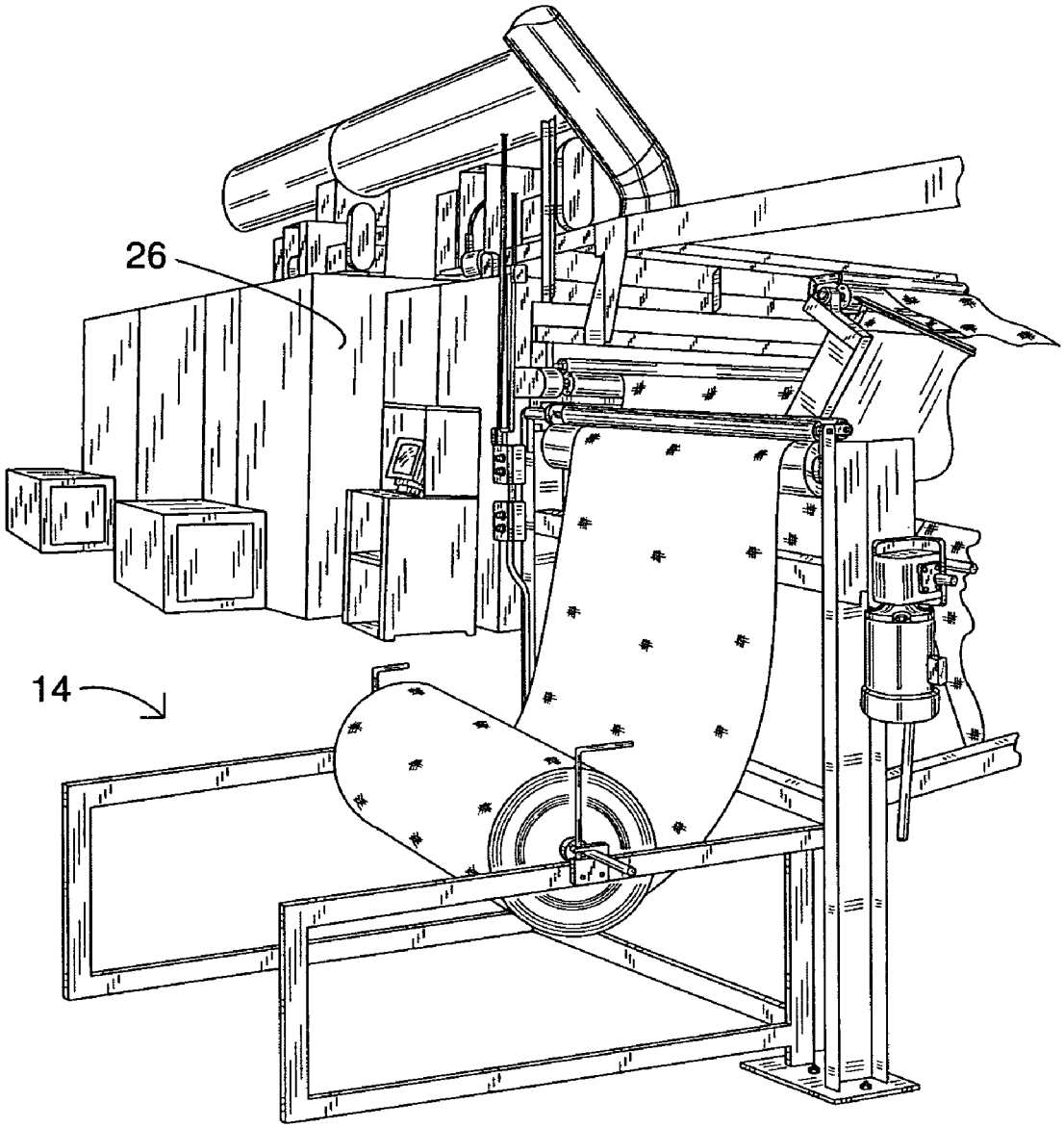
FIG. 4 is a perspective view of a thermal relaxation station.
Figure 5:
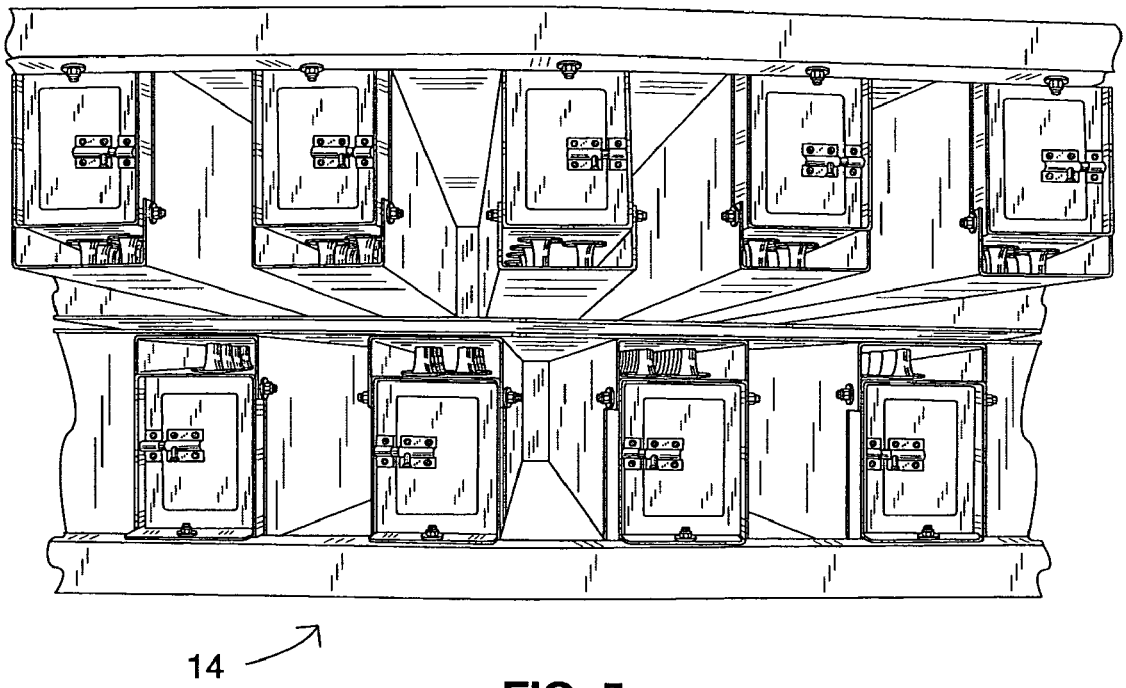
FIG. 5 is a side view of the inside of the thermal relaxation station of FIG. 4.
Figure 6:
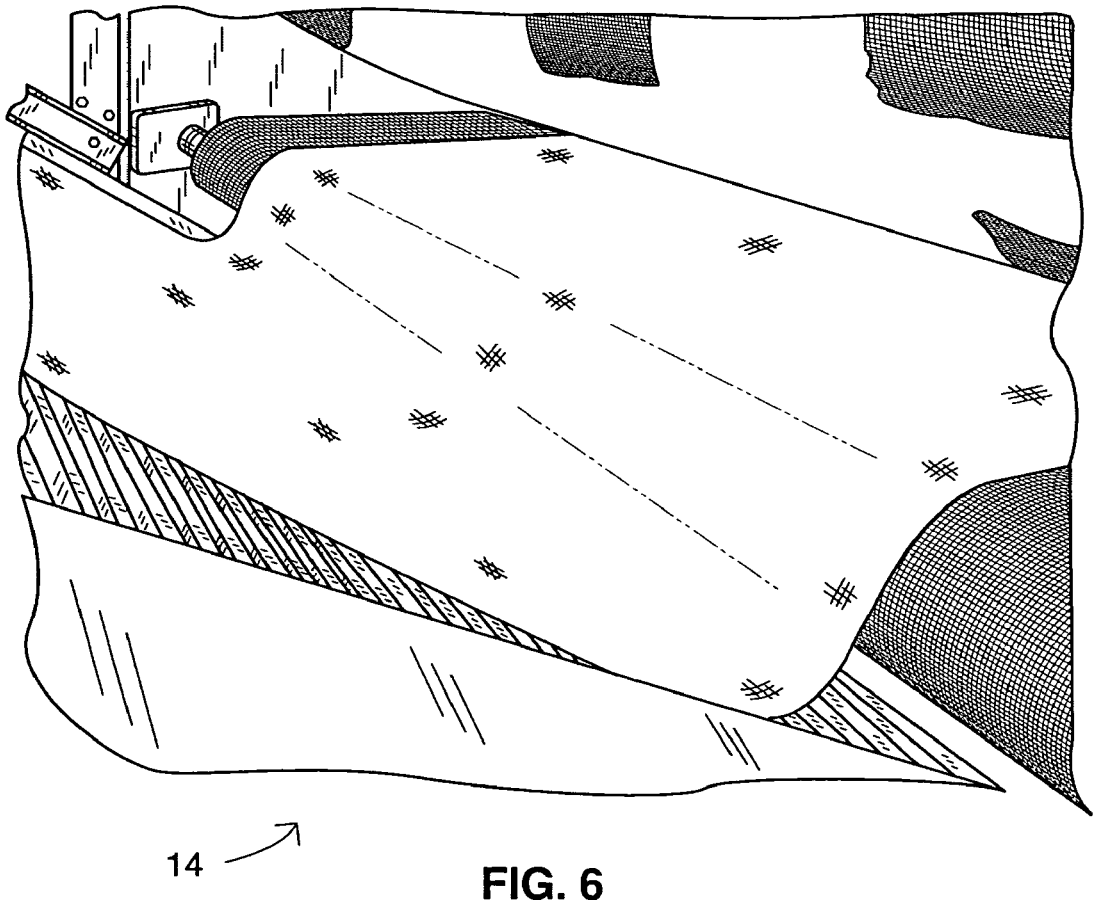
FIG. 6 is a perspective view of the exit of the thermal relaxation station of FIGS. 4 and 5.
Figure 7:
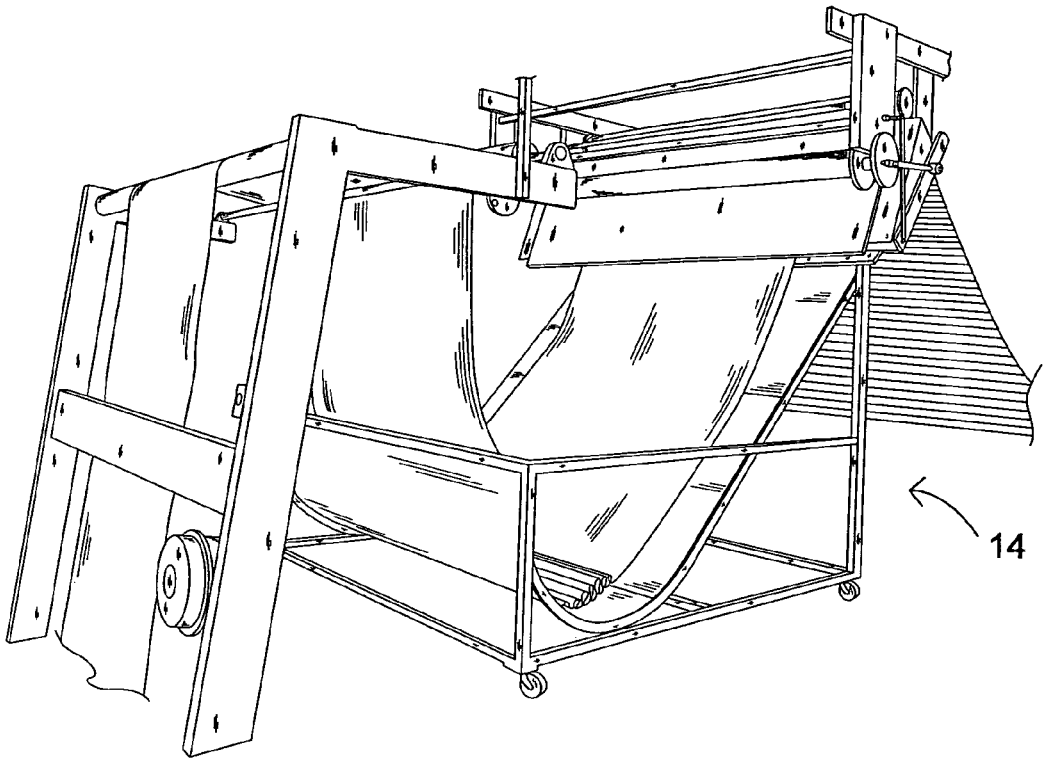
FIG. 7 is an end view of the exit of the thermal relaxation station of FIG. 6 showing a dry scray accumulator.

FIG. 4 is a perspective view of a thermal relaxation station 14; FIG. 5 is a side view of the inside of the thermal relaxation station 14 of FIG. 4; FIG. 6 is a perspective view of the exit of the thermal relaxation station 14 of FIGS. 4 and 5; and FIG. 7 is an end perspective view of the exit of the thermal relaxation station 14 of FIG. 6 showing a substantially tension free transfer station. The thermal relaxation station 14 includes an overfeed device 26 for overfeeding the fabric in the wale direction. The overfeed of the overfeed device 26 is greater than the fabric length shrinkage. The ratio of the overfeed to the fabric length shrinkage is about 1.4. In the preferred embodiment, the fabric shrinks to about 70 percent of its original dimension in the wale direction. The overfeed compensates for this shrinkage. The overfeed device 26 includes a tensionless, three-zone dryer. The thermal relaxation station is preferably between about 100 degrees Fahrenheit and 400 degrees Fahrenheit air temperature, most preferably about 225 degrees Fahrenheit average air temperature. In the preferred embodiment, the first zone of the tensionless, three zone dryer 26 is about 150 degrees Fahrenheit air temperature; the second zone is about 200 degrees Fahrenheit air temperature; and the third zone is about 230 degrees Fahrenheit air temperature. The exit end of the thermal relaxation station 14 may include a substantially tension free transfer station. The substantially tension free transfer station may be an accumulator. The accumulator may be dry scray accumulator. The substantially tension free transfer station may be a buggy. The substantially tension free transfer station may be a belt conveyor.

Figure 8:
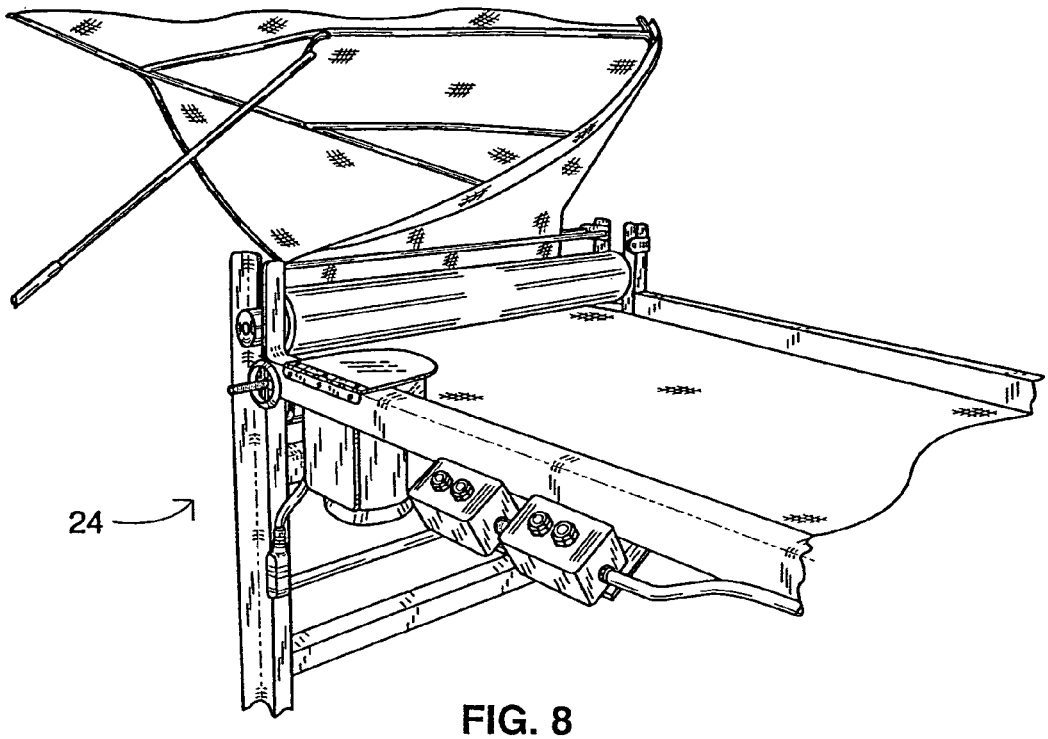
FIG. 8 is a is a perspective view of a slitting station.
Figure 9:
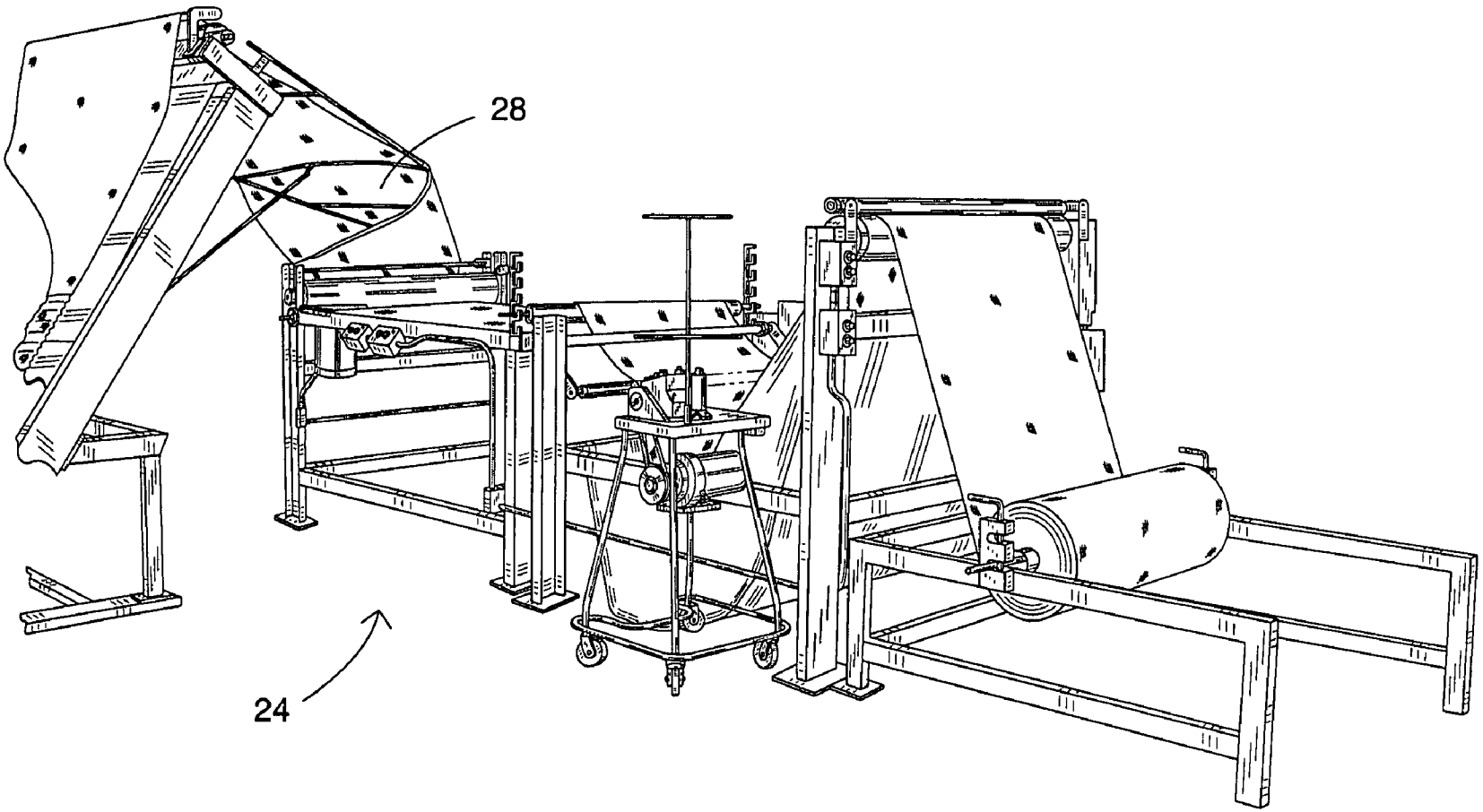
FIG. 9 is an additional perspective view of the slitting station of FIG. 8.
Figure 10:
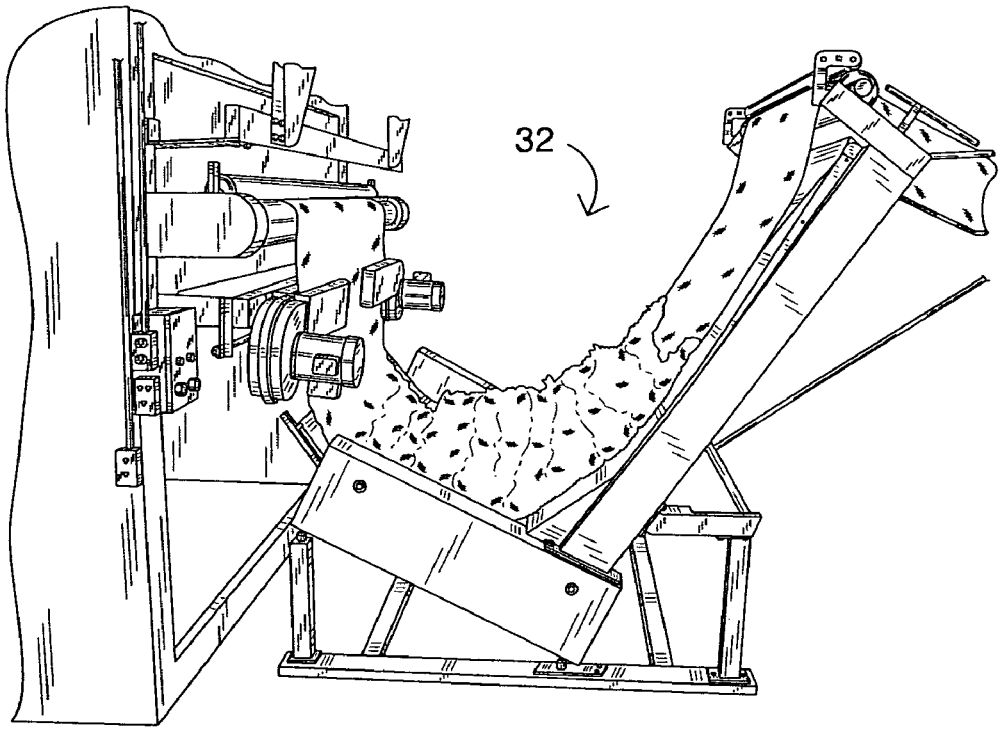
FIG. 10 is a perspective view of an accumulator.

FIG. 8 is a perspective view of a slitting station 24 and FIG. 9 is an additional perspective view of the slitting station 24 of FIG. 8. The slitting station 24 is a side slitter. The slitting station includes a spreader 28. The slitting station further includes an accumulator 32 downstream from the spreader 28. FIG. 10 is a perspective view of an accumulator 32. The accumulator 32 may be a dry scray accumulator.

Figure 11:
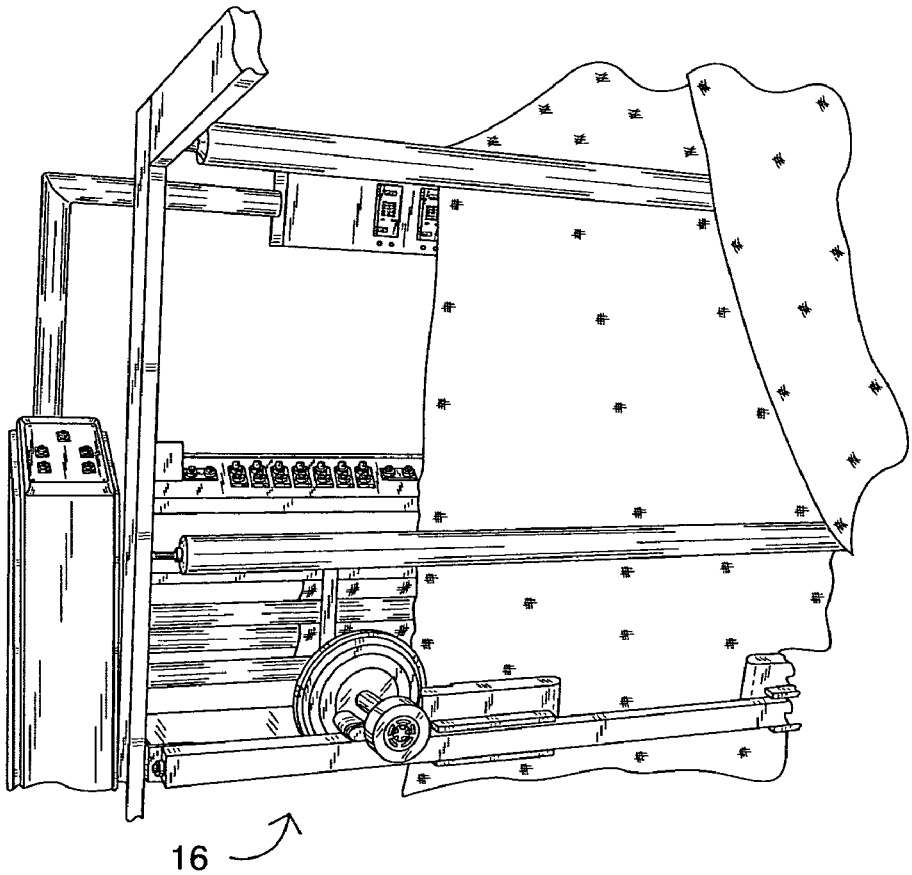
FIG. 11 is a perspective view of the entrance of a finishing station.
Figure 12:
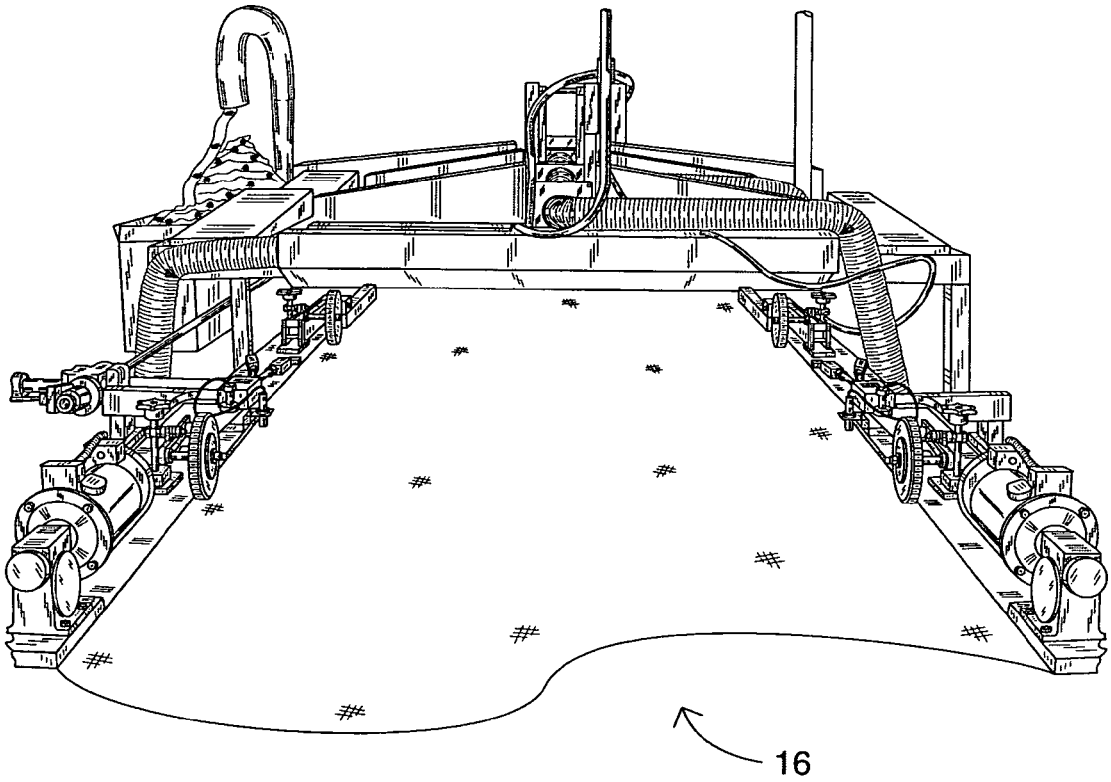
FIG. 12 is a perspective view of a thermal finishing station.
Figure 13:
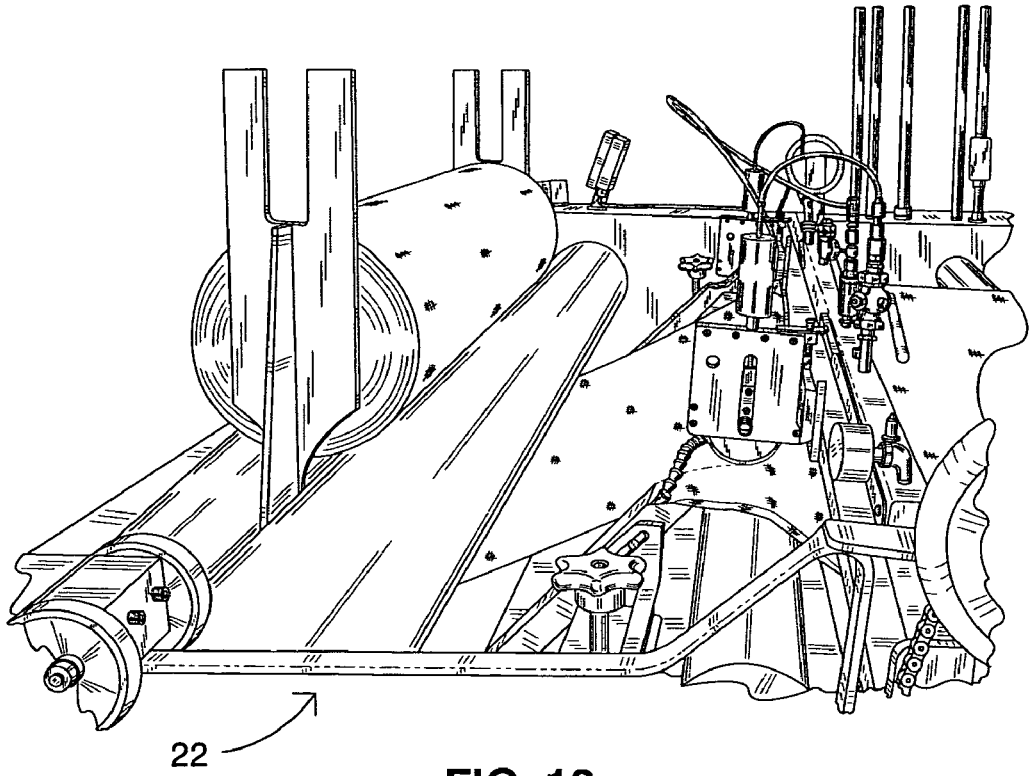
FIG. 13 is a perspective view of a thermal finishing station take-up roll.
Figure 14:
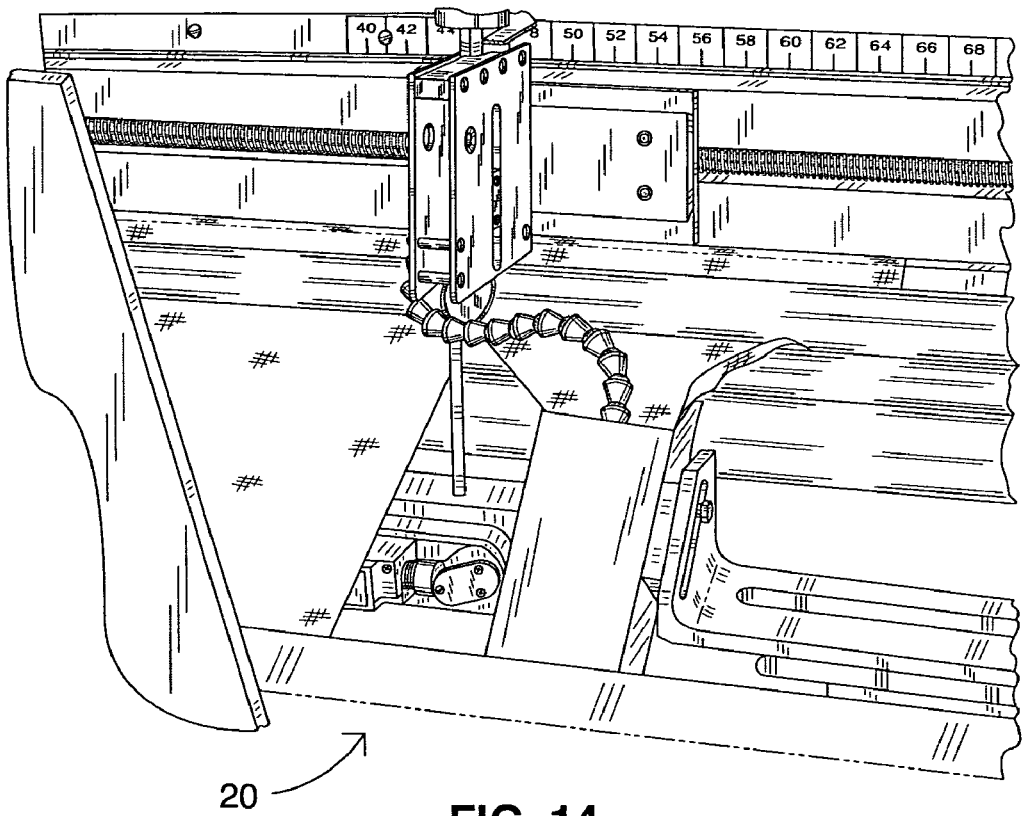
FIG. 14 is a perspective view of a width trimmer for a thermal finishing station.

FIG. 11 is a perspective view of the entrance of a finishing station 16 and FIG. 12 is a perspective view of a thermal finishing station 16. The thermal finishing station 16 is downstream from the thermal relaxation station 14 (shown in FIGS. 4, 5, 6, and 7). The thermal finishing station 16 is an overfeed tenter frame. The overfeed tenter frame is a pin-type tenter frame. The application temperature of the thermal finishing station 16 is preferably between about 100 degrees Fahrenheit and 300 degrees Fahrenheit fabric temperature. The application temperature is most preferably about 200 degrees Fahrenheit fabric temperature. FIG. 13 is a perspective view of take-up roll 22 for a thermal finishing station. FIG. 14 is a perspective view of a width trimmer 20 for a thermal finishing station 16.

Figure 15:
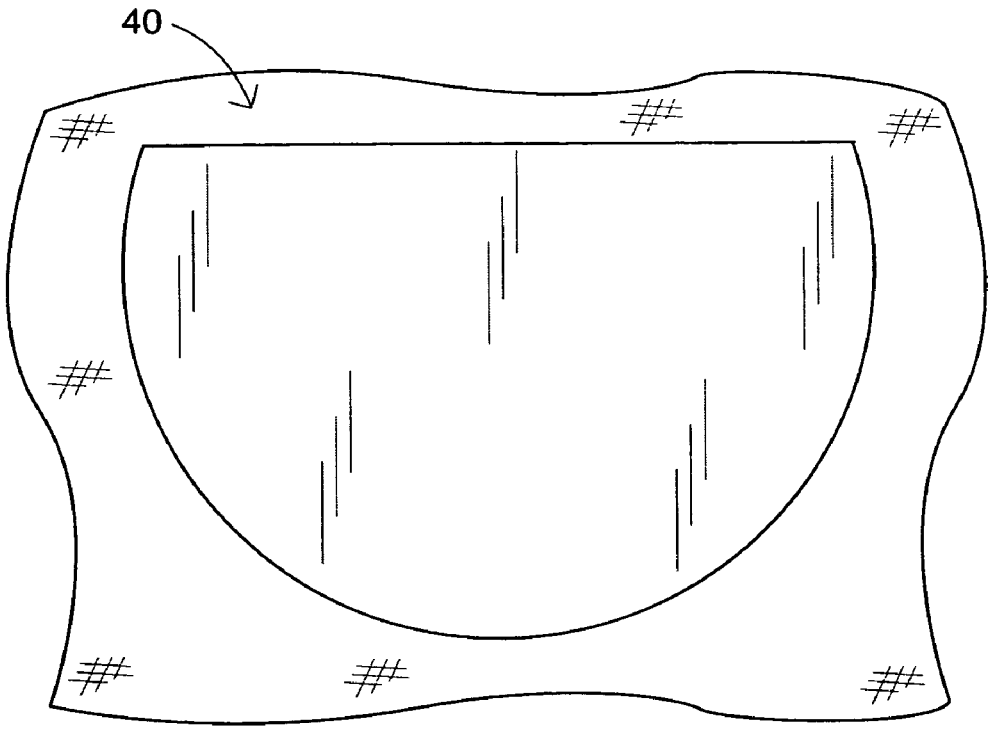
FIG. 15 is a top view of the vinyl side of a coated fabric.
Figure 16:
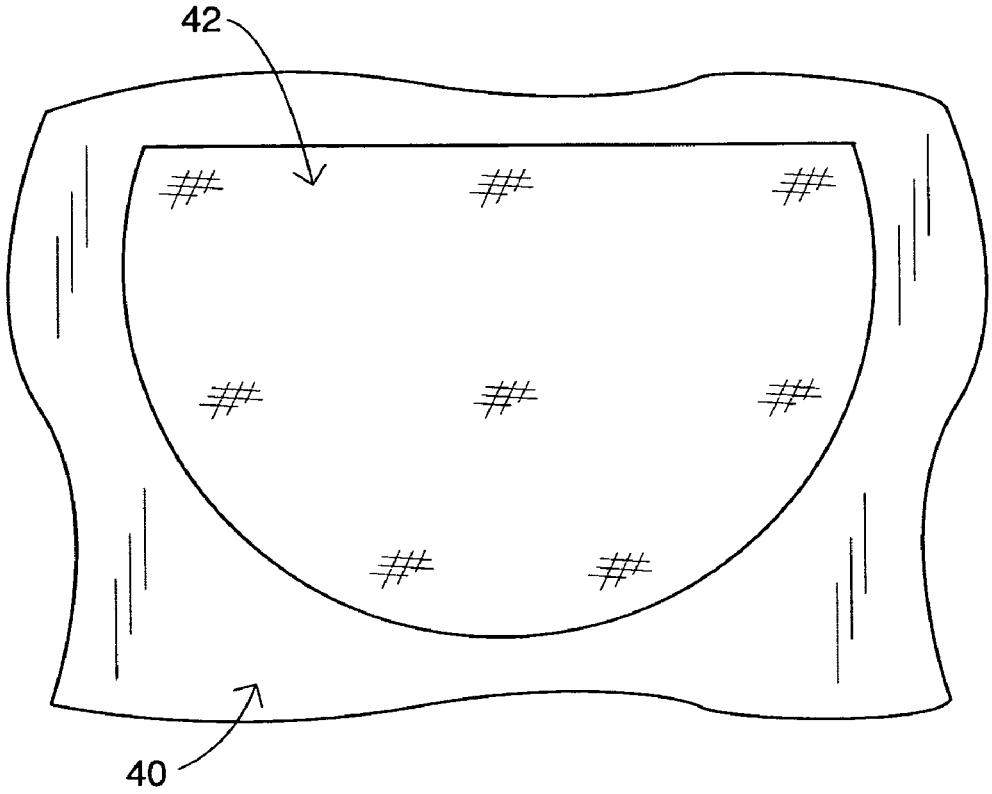
FIG. 16 is a top view of the knit side of a coated fabric.

FIG. 15 is a top view of the vinyl side of a coated fabric 40 and FIG. 16 is a top view of the knit side of a coated fabric 40. The coated fabric 40 includes a circular knitted, single knit fabric substrate 42, wherein the stretch of the fabric in the wale direction is greater than the stretch of the fabric in the course direction. In the preferred embodiment, the fabric is formed by a four feed repeat. The coated fabric 40 includes an outer coating 44, which may be a synthetic coating, such as a vinyl coating.

Figure 17:
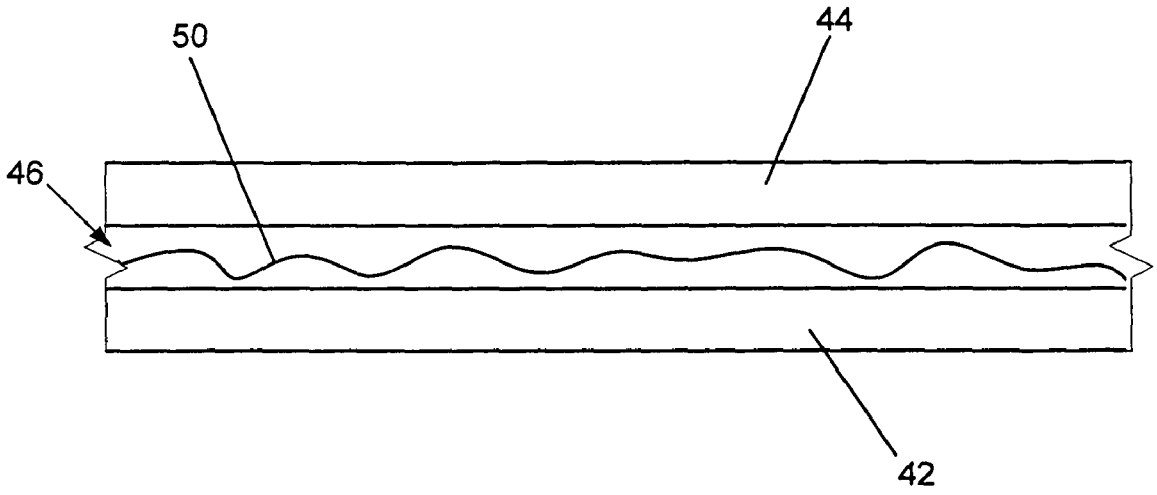
FIG. 17 is an enlarged cross-sectional side view of the coated fabric of FIGS. 15 and 16.

FIG. 17 is an enlarged cross-sectional side view of the coated fabric of FIGS. 15 and 16. The coated fabric 40 may include an intermediate coating 46 between the fabric substrate 42 and the outer coating 44. The intermediate coating 46 may include an adhesive 50. The intermediate coating may include an expander 51. Preferably, the length direction stretch of the circular knitted fabric substrate 42 is between about 125% and 175%. Most preferably, the width direction stretch of the circular knitted fabric substrate 42 is about 150%. Preferably, the width direction stretch of the circular knitted fabric substrate 42 is between about 75% and 125%. Most preferably, the course direction stretch of the circular knitted fabric substrate 42 is about 100%. The ratio of the wale direction stretch of the circular knitted fabric substrate 42 to the course direction stretch of the circular knitted fabric substrate 42 is between about 1.05 and 2. Preferably, the ratio of the wale direction stretch of the circular knitted fabric substrate 42 to the course direction stretch of the circular knitted substrate 42 is about 1.5. The circular knitted fabric substrate 42 is formed from continuous multi filament yarn. The continuous multi filament yarn may be 1/150/36. The continuous multi filament yarn may be a "high shrink". The Leesona shrinkage of the "high shrink" yarn may be between about 20-60%. In the preferred embodiment, the Leesona shrinkage of the "high shrink" yarn is about 44%.

Certain modifications and improvements will occur to those skilled in the art upon a reading of the foregoing description. By way of example, the slitting station, thermal relaxation station, and thermal finishing station can be combined into one station with no material handling necessary between the operations. Also, a stretch-wrap packaging operation can be added to or immediately follow the thermal finishing station to protect the stretch characteristics of the fabric during subsequent handling. In addition, an overfeed tenter frame may be used to combine the thermal relaxation and thermal finishing station into a continuous process performed on a single machine. All such modifications and improvements have been deleted herein for the sake of conciseness and readability but are properly within the scope of the following claims.

I claim:

1. An apparatus for forming an unbalanced circular knit fabric for coating in a subsequent operation, said apparatus comprising:

(a) a circular knitting station;

(b) a slitting station including a spreader and a slitter, said spreader directly downstream from said slitter, said slitting station downstream from said circular knitting station; and (c) a thermal relaxation station downstream from said spreader for relaxing said fabric in all directions.

2. The apparatus according to claim 1, further including a thermal finishing station downstream from said thermal relaxation station for setting the desired width of the fabric thereby also setting the desired stretch of the fabric in its length direction.

3. The apparatus according to claim 2, wherein said thermal finishing station is an overfeed tenter frame.

4. The apparatus according to claim 3, wherein said overfeed tenter frame is a pin-type tenter frame.

5. The apparatus according to claim 2, wherein said application temperature of said thermal finishing station is between about 100° F. and 300° F. fabric temperature.

6. The apparatus according to claim 5, wherein said application temperature is about 200° F. fabric temperature.

7. The apparatus according to claim 2, wherein said thermal finishing station further includes a fabric width trimmer.

8. The apparatus according to claim 2, wherein said thermal finishing station further includes a take-up roll.

9. The apparatus according to claim 1, wherein said circular knitting station forms a single knit fabric.

10. The apparatus according to claim 9, wherein said single knit fabric is a modified LaCoste construction.

11. The apparatus according to claim 10, wherein said modified LaCoste construction is a four feed repeat.

12. The apparatus according to claim 11, wherein said four feed repeat has a cam set up according to the following table:

where K=

| | F1 | F2 | F3 | F4 |
|---|---|---|---|---|
| T1 | K | K | W | T |
| T2 | W | T | K | K |

Knit, W=Welt, and T=Tuck.

13. The apparatus according to claim 11, wherein said four feed repeat has a needle set up according to the following table:

where X=

| | F1 | F2 | F3 | F4 |
|---|---|---|---|---|
| T1 | X | | X | |
| T2 | | X | | X |

Needle In.

14. The apparatus according to claim 1, wherein said circular knitting machine is between about an 18 inch and 60 inch diameter cylinder.

15. The apparatus according to claim 14, wherein said circular knitting machine is a 30 inch diameter cylinder.

16. The apparatus according to claim 1, wherein said circular knitting machine is between about a 12 and 28 cut.

17. The apparatus according to claim 16, wherein said circular knitting machine is an 18 cut.

18. An apparatus for forming an unbalanced circular knit fabric for coating in a subsequent operation, said apparatus comprising:

(a) a circular knitting station;

(b) a slitting station including a slitter and a spreader, said spreader directly downstream from said slitter, and said slitting station downstream from said circular knitting station; and (c) a thermal relaxation station downstream from said slitting station for relaxing said fabric in all directions.

19. The apparatus according to claim 18, wherein said thermal relaxation station includes an overfeed device for overfeeding said fabric in the wale direction.

20. The apparatus according to claim 19, wherein the overfeed of said overfeed device is greater than the fabric length shrinkage.

21. The apparatus according to claim 20, wherein the ratio of said overfeed to said fabric length shrinkage is about 1.4.

22. The apparatus according to claim 19, wherein said overfeed device includes a tensionless dryer.

23. The apparatus according to claim 22, wherein said tensionless dryer is a three zone dryer.

24. The apparatus according to claim 23, wherein said first zone is about 150° F. air temperature, said second zone is about 200° F. air temperature and said third zone is about 230° F. air temperature.

25. The apparatus according to claim 18, wherein said thermal relaxation station is between about 100° F. and 400° F. average air temperature.

26. The apparatus according to claim 25, wherein said thermal relaxation station is about 225° F. average air temperature.

27. The apparatus according to claim 18, wherein said slitter is a side slitter.

28. The apparatus according to claim 27, wherein said slitting station further includes an accumulator downstream from said spreader.

29. The apparatus according to claim 18, further including a substantially tension free transfer station downstream from said thermal relaxation station.

30. The apparatus according to claim 29, wherein said substantially tension free transfer station is an accumulator.

31. The apparatus according to claim 29, wherein said substantially tension free transfer station is a buggy.

32. The apparatus according to claim 27, wherein said substantially tension free transfer station is a belt conveyor.

33. An apparatus for forming an unbalanced, circular knit fabric for coating in a subsequent operation, said apparatus comprising:

(a) a circular knitting station;

(b) a slitting station including a slitter and a spreader, said spreader directly downstream of said slitter, and said slitting station downstream from said circular knitting station;

(c) a thermal relaxation station downstream from said spreader for relaxing said fabric in all directions; and (d) a thermal finishing station downstream from said thermal relaxation station for setting the desired width of the fabric thereby also setting the desired stretch of the fabric in its length direction.

34. The apparatus according to claim 33, wherein said thermal finishing station is an overfeed tenter frame.

35. The apparatus according to claim 34, wherein said overfeed tenter frame is a pin-type tenter frame.

36. The apparatus according to claim 33, wherein said application temperature of said thermal finishing station is between about 100° F. and 300° F. fabric temperature.

37. The apparatus according to claim 36, wherein said application temperature is about 200° F. fabric temperature.

38. The apparatus according to claim 33, wherein said thermal finishing station further includes a fabric width trimmer.

39. The apparatus according to claim 33, wherein said thermal finishing station further includes a take-up roll.

40. The apparatus according to claim 33, wherein said circular knitting station forms a single knit fabric.

41. The apparatus according to claim 40, wherein said single knit fabric is a modified LaCoste construction.

42. The apparatus according to claim 41, wherein said modified LaCoste construction is a four feed repeat.

43. The apparatus according to claim 42, wherein said four feed repeat has a cam set up according to the following table:

where K=

| | F1 | F2 | F3 | F4 |
|---|---|---|---|---|
| T1 | K | K | W | T |
| T2 | W | T | K | K |

Knit, W=Welt, and T=Tuck.

44. The apparatus according to claim 42, wherein said four feed repeat has a needle set up according to the following table:

where X=

| | F1 | F2 | F3 | F4 |
|---|---|---|---|---|
| T1 | X | | X | |
| T2 | | X | | X |

Needle In.

45. The apparatus according to claim 33, wherein said circular knitting machine is between about an 18 inch and 60 inch diameter cylinder.

46. The apparatus according to claim 45, wherein said circular knitting machine is a 30-inch diameter cylinder.

47. The apparatus according to claim 33, wherein said circular knitting machine is between about a 12 and 28 cut.

48. The apparatus according to claim 47, wherein said circular knitting machine is an 18 cut.

49. The apparatus according to claim 33, wherein said thermal relaxation station includes an overfeed device for overfeeding said fabric in the wale direction.

50. The apparatus according to claim 49, wherein the overfeed of said overfeed device is greater than the fabric length shrinkage.

51. The apparatus according to claim 50, wherein the ratio of said overfeed to said fabric length shrinkage is about 1.4.

52. The apparatus according to claim 49, wherein said overfeed device includes a tensionless dryer.

53. The apparatus according to claim 52, wherein said tensionless dryer is a three zone dryer.

54. The apparatus according to claim 53, wherein said first zone is about 150° F. air temperature, said second zone is about 200° F. air temperature and said third zone is about 230° F. air temperature.

55. The apparatus according to claim 33, wherein said thermal relaxation station is between about 100° F. and 400° F. average air temperature.

56. The apparatus according to claim 55, wherein said thermal relaxation station is about 225° F. average air temperature.

57. The apparatus according to claim 33, wherein said slitter is a side slitter.

58. The apparatus according to claim 57, further including an accumulator downstream from said spreader.

59. The apparatus according to claim 33, further including a substantially tension free transfer station downstream from said thermal relaxation station.

60. The apparatus according to claim 59, wherein said substantially tension free transfer station is an accumulator.

61. The apparatus according to claim 59, wherein said substantially tension free transfer station is a buggy.

62. The apparatus according to claim 57, wherein said substantially tension free transfer station is a belt conveyor.

* * * * *